US010217402B1

(12) United States Patent
Vahid Far et al.

(10) Patent No.: US 10,217,402 B1
(45) Date of Patent: Feb. 26, 2019

(54) DRIVING CIRCUITRY FOR MICRO LIGHT EMITTING DIODE ELECTRONIC DISPLAYS

(71) Applicants: Mohammad B. Vahid Far, San Jose, CA (US); Yafei Bi, Palo Alto, CA (US); Shinya Ono, Cupertino, CA (US); Hopil Bae, Sunnyvale, CA (US); Chieh-Chien Lin, San Jose, CA (US); Hasan Akyol, Mountain View, CA (US); Xiaofeng Wang, San Jose, CA (US)

(72) Inventors: Mohammad B. Vahid Far, San Jose, CA (US); Yafei Bi, Palo Alto, CA (US); Shinya Ono, Cupertino, CA (US); Hopil Bae, Sunnyvale, CA (US); Chieh-Chien Lin, San Jose, CA (US); Hasan Akyol, Mountain View, CA (US); Xiaofeng Wang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 204 days.

(21) Appl. No.: 15/247,634

(22) Filed: Aug. 25, 2016

Related U.S. Application Data

(60) Provisional application No. 62/232,918, filed on Sep. 25, 2015.

(51) Int. Cl.
*G09G 3/22* (2006.01)
*G09G 3/20* (2006.01)

(52) U.S. Cl.
CPC ..... *G09G 3/22* (2013.01); *G09G 3/2003* (2013.01); *G09G 2300/08* (2013.01);
(Continued)

(58) Field of Classification Search
CPC ..... G09G 2310/08; G09G 2300/043; G09G 3/3233; G09G 3/3258
See application file for complete search history.

(56) References Cited

U.S. PATENT DOCUMENTS

2009/0109150 A1* 4/2009 Han ..... G09G 3/3233 345/82
2013/0141412 A1* 6/2013 Kang ..... G09G 3/3233 345/212

(Continued)

*Primary Examiner* — Abbas I Abdulselam
(74) *Attorney, Agent, or Firm* — Fletcher Yoder, PC

(57) ABSTRACT

Methods and devices useful in compensating for $V_{DD}$ and $V_{TH}$ variations in a micro light-emitting diode (micro-LED) display are provided. By way of example, an LED driver includes a first transistor having a first source coupled to an upper voltage rail ($V_{DD}$), a first gate, and a first drain. The LED driver includes a second transistor having a second source coupled to the first drain of the first transistor, a second gate, and a second drain coupled to the LED. The second transistor is configured to receive the drive current signal from the first transistor and supply the drive current signal to the LED. The LED driver includes compensation circuitry configured to adjust the drive current signal such that the drive current signal is independent of the upper voltage rail ($V_{DD}$) and a threshold voltage ($V_{TH}$) of the first transistor or the second transistor.

18 Claims, 16 Drawing Sheets

(52) U.S. Cl.
CPC . *G09G 2310/0272* (2013.01); *G09G 2320/02* (2013.01); *G09G 2330/021* (2013.01)

(56) References Cited

U.S. PATENT DOCUMENTS

2014/0299837 A1* 10/2014 Bibl ..... H01L 33/04
257/13
2016/0148564 A1* 5/2016 Kim ..... G09G 3/3233
345/211

* cited by examiner

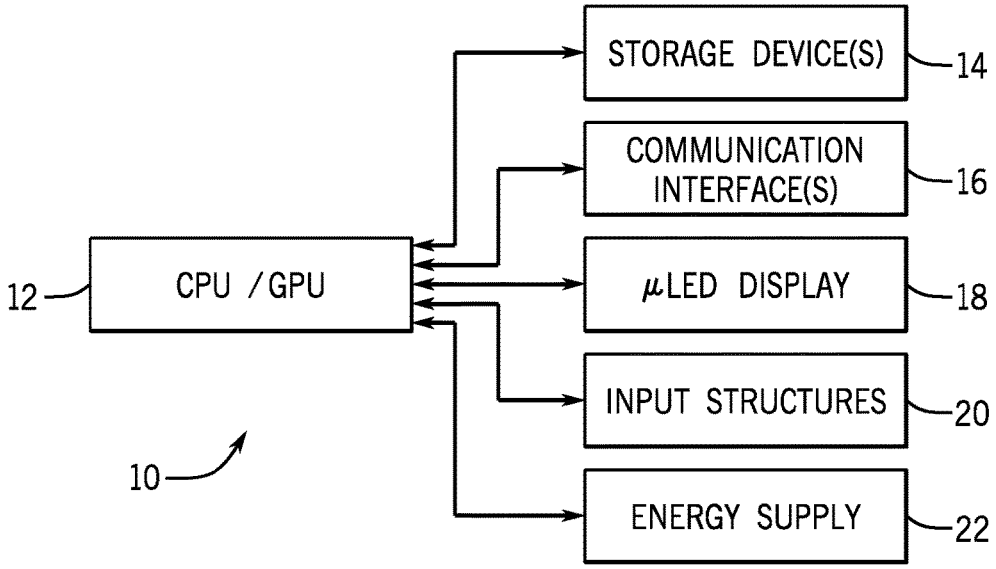
FIG. 1
FIG. 2
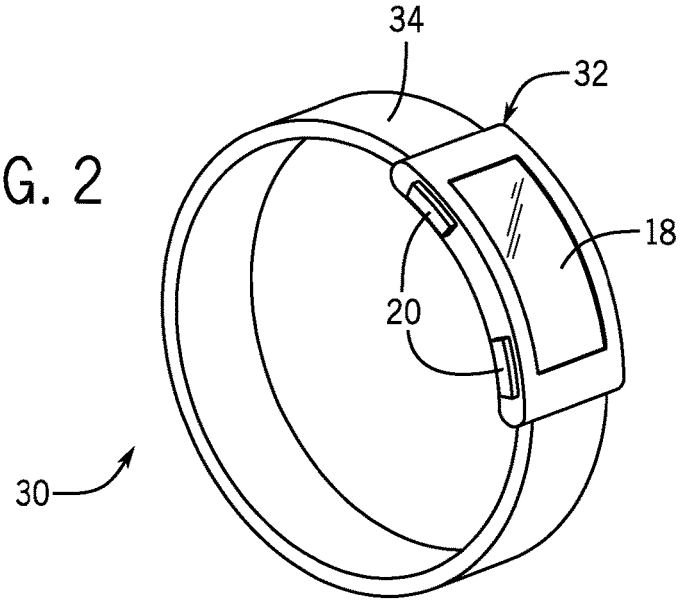

DRIVING CIRCUITRY FOR MICRO LIGHT EMITTING DIODE ELECTRONIC DISPLAYS

BACKGROUND

The present disclosure relates generally to electronic displays and, more particularly, to electronic displays with reduced or eliminated mura artifacts.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays may be found in a variety of devices, such as computer monitors, televisions, instrument panels, mobile phones, and clocks. One type of electronic display is known as a micro light-emitting diode (uLED) display, which includes pixels of LEDs for displaying image data. The uLED display may include micro drivers that may utilize p-type metal-oxide-semiconductor (PMOS) drivers used to drive the LED devices. For example, PMOS drivers may be used as part of the micro drivers in order to conserve physical area of the uLED display by avoiding level shifters that may be otherwise involved. However, utilizing PMOS drivers as part of the micro drivers may lead to image artifacts (e.g., flicker) becoming present on the uLED display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Various embodiments of the present disclosure relate to methods and devices useful in compensating for $V_{DD}$ and $V_{TH}$ variations in a micro light-emitting diode (micro-LED) display. By way of example, an LED driver includes a first transistor having a first source coupled to an upper voltage rail ($V_{DD}$), a first gate, and a first drain. The LED driver includes a second transistor having a second source coupled to the first drain of the first transistor, a second gate, and a second drain coupled to the LED. The second transistor is configured to receive the drive current signal from the first transistor and supply the drive current signal to the LED. The LED driver includes compensation circuitry configured to adjust the drive current signal such that the drive current signal is independent of the upper voltage rail ($V_{DD}$) and a threshold voltage ($V_{TH}$) of the first transistor or the second transistor.

Various refinements of the features noted above may exist in relation to various aspects of the present disclosure. Further features may also be incorporated in these various aspects as well. These refinements and additional features may exist individually or in any combination. For example, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 1 is a block diagram of components of an electronic device that may include a micro light emitting diode (μ-LED) display, in accordance with an embodiment;

FIG. 2 is a perspective view of the electronic device in the form of a fitness band, in accordance with an embodiment;

DETAILED DESCRIPTION

Figure 3:
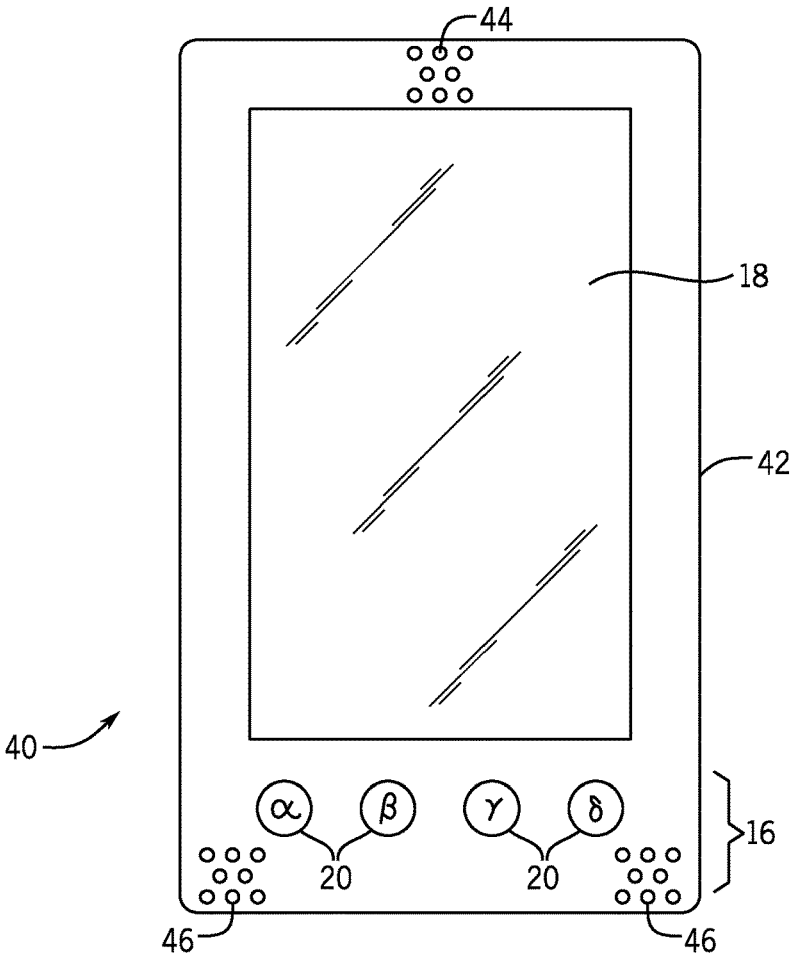
FIG. 3 is a front view of the electronic device in the form of a slate, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to upper voltage rail $V_{DD}$ and threshold voltage $V_{TH}$ compensation circuitry that may be used to compensate for the $V_{DD}$ and $V_{TH}$ variations that may be due to, for example, IR drop (e.g., voltage drops across the resistance R of the power supply between supply pins and one or more components drawing a current I) associated the high voltage potential rail (e.g., "$V_{DD}$") in micro light-emitting diode (uLED) displays. In certain embodiments, the micro drivers including p-type metal-oxide-semiconductor (PMOS) devices may be set to operate over one or more phases of the drive currents (e.g., "$I_{LED}$") of the LED devices to compensate for the $V_{DD}$ and $V_{TH}$ variations, and may generate a drive current for the LED devices independent of $V_{DD}$ and $V_{TH}$. In another embodiment, the micro drivers including n-type metal-oxide-semiconductor (NMOS) devices may be set to operate over one or more phases of the drive currents (e.g., "$I_{LED}$") to compensate for the lower voltage rail $V_{SS}$ and threshold voltage $V_{TH}$ variations, and may generate a drive current for the LED devices independent of $V_{SS}$ and $V_{TH}$ In this way, any possible occurrence of image artifacts becoming apparent on the uLED display due to $V_{DD}$, $V_{SS}$, and $V_{TH}$ signal variations may be reduced or substantially eliminated.

A general description of suitable electronic devices that may include a micro-LED (μ-LED) display and corresponding circuitry of this disclosure are provided. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a long-term evolution (LTE) cellular network.

Using pixels containing an arrangement μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

As may be appreciated, the electronic device 10 may take a number of different forms. As shown in FIG. 2, the electronic device 10 may take the form of a fitness band 30. The fitness band 30 may include an enclosure 32 that houses the electronic device 10 components of the fitness band 30. A strap 30 may allow the fitness band 30 to be worn on the arm or wrist. The display 18 may display information related to the fitness band operation. Additionally or alternatively, the fitness band 30 may operate as a watch, in which case the display 18 may display the time. Input structures 20 may allow a person wearing the fitness band 30 navigate a graphical user interface (GUI) on the display 18.

The electronic device 10 may also take the form of a slate 40. Depending on the size of the slate 40, the slate 40 may serve as a handheld device such as a mobile phone. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired connection to another electronic device.

Figure 4:
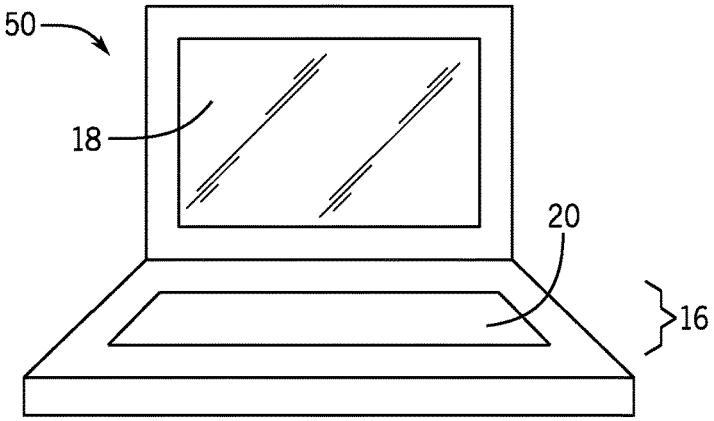
FIG. 4 is a perspective view of the electronic device in the form of a notebook computer, in accordance with an embodiment.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal service bus (USB) connection.

Figure 5:
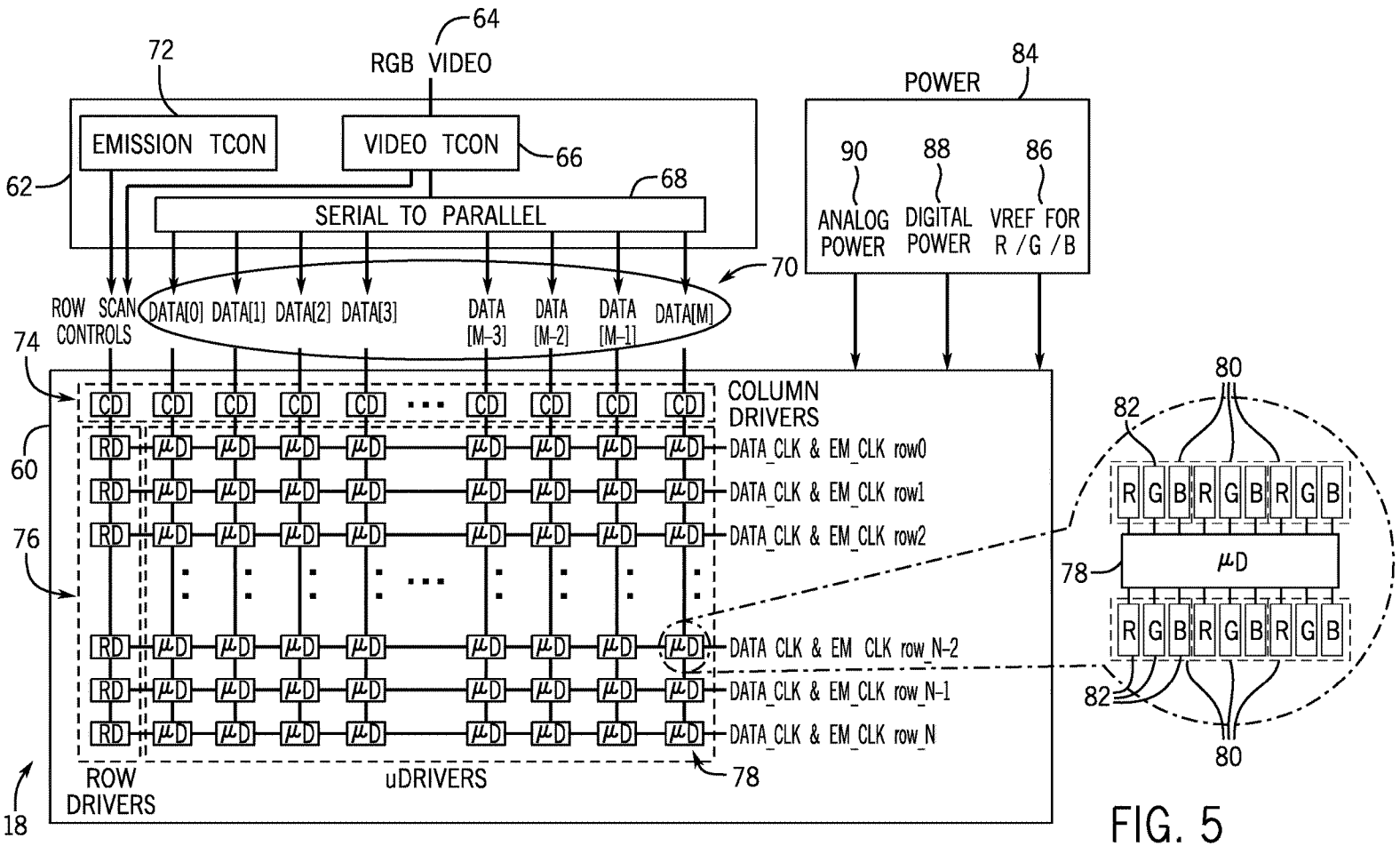
FIG. 5 is a block diagram of a μ-LED display that employs micro-drivers (μDs) to drive μ-LED sub-pixels with control signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as subpixels. Support circuitry 62 thus may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial signal to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[0], DATA[1], DATA[2], DATA[3] . . . DATA[M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 includes column drivers (CDs) 74, row drivers (RDs) 76, and micro-drivers (μDs or uDs) 78. Each uD 78 drives a number of pixels 80 having μ-LEDs as subpixels 82. Each pixel 80 includes at least one red μ-LED, at least one green μ-LED, and at least one blue μ-LED to represent the image data 64 in RGB format. Although the uDs 78 of FIG. 5 is shown to drive six pixels 80 having three subpixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage (VREF) 86 to drive the μ-LEDs, a digital power signal 88, and an analog power signal 90. In some cases, the power supply 84 may provide more than one reference voltage (VREF) 86 signal. Namely, subpixels 82 of different colors may be driven using different reference voltages. As such, the power supply 84 may provide more than one reference voltage (VREF) 86. Additionally or alternatively, other circuitry on the display panel 60 may step the reference voltage (VREF) 86 up or down to obtain different reference voltages to drive different colors of μ-LED.

To allow the μDs 78 to drive the μ-LED subpixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate to activate the row of μDs 78 driven by the RD 76. A row of uDs 78 may be activated when the RD 76 that controls that row sends the data clock signal (DATA_CLK). This may cause the now-activated uDs 78 of that row to receive and store the digital image data 70 signal that is driven by the column drivers (CDs) 74. The uDs 78 of that row then may drive the pixels 80 based on the stored digital image data 70 signal based on the emission clock signal (EM_CLK).

Figure 6:
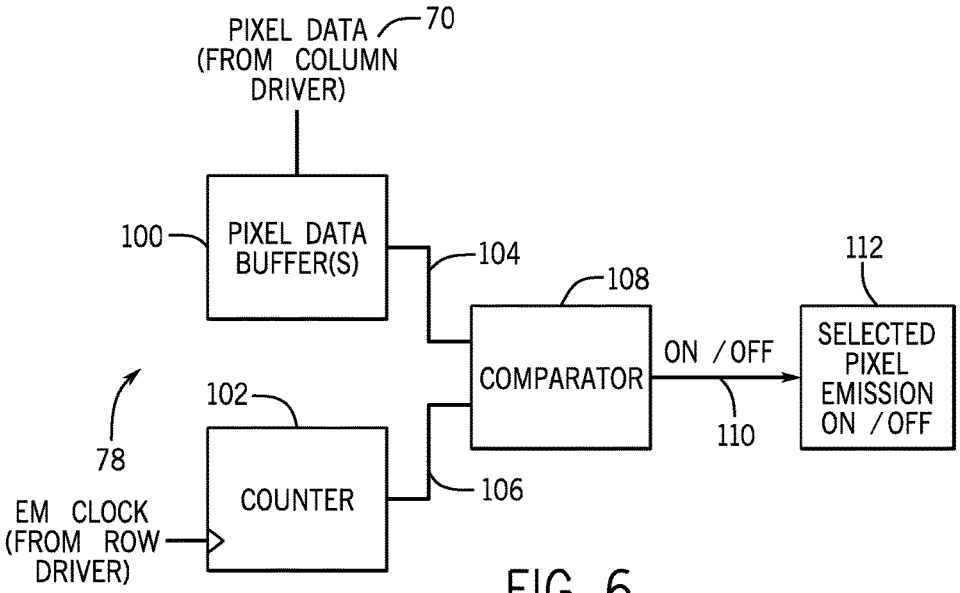
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include pixel data buffers to store image data 70 for three subpixels 82 at any one time (e.g., for 8-bit image data 70, this may be 24 bits of storage). It should be appreciated, however, that the μD 78 may include more or fewer buffers, depending on the data rate of the image data 70 and the number of subpixels 82 included in the image data 70. The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular subpixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the subpixel 82 being driven, which may cause light emission 112 from the selected subpixel 82 to be on or off. The longer the selected subpixel 82 is driven "on" by the emission control signal 110, the greater the amount of light that will be perceived by the human eye as originating from the subpixel 82.

Figure 7:
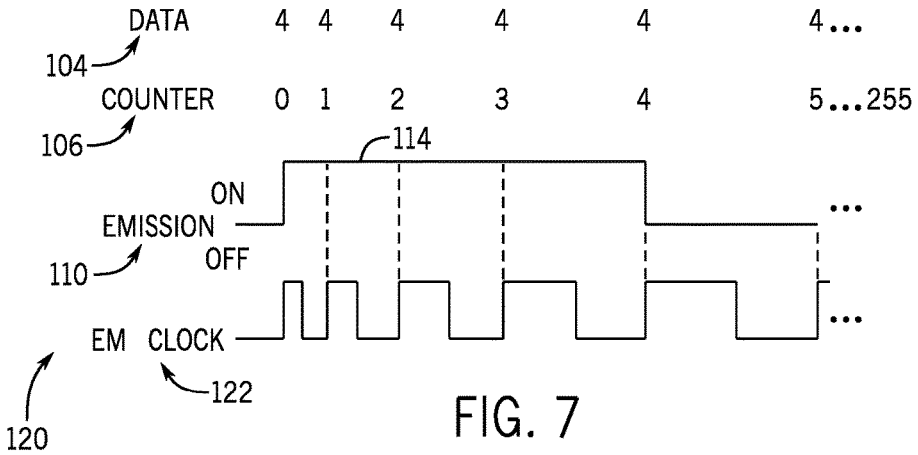
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected subpixel 82 is gray level 4, and this is reflected in the digital data signal 104. The emission control signal 110 drives the subpixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected subpixel 82 no longer to emit light.

It should be noted that the steps between gray levels are reflected by the steps between emission clock signal (EM_CLK) edges. That is, based on the way humans perceive light, to notice the difference between lower gray levels, the difference between the amount of light emitted between two lower gray levels may be relatively small. To notice the difference between higher gray levels, however, the difference between the amount of light emitted between two higher gray levels may be comparatively much greater. The emission clock signal (EM_CLK) therefore may use relatively short time intervals between clock edges at first. To account for the increase in the difference between light emitted as gray levels increase, the differences between edges (e.g., periods) of the emission clock signal (EM_CLK) may gradually lengthen. The particular pattern of the emission clock signal (EM_CLK), as generated by the emission TCON 72, may have increasingly longer differences between edges (e.g., periods) so as to provide a gamma encoding of the gray level of the subpixel 82 being driven.

Various components of the electronic device 10 may be used to control the current signal supplied to drive LED devices 102 of the uLED display 18. For example, as will be further appreciated, the uDs 78 may include a p-type metal-oxide-semiconductor (PMOS) device, an n-type metal-oxide-semiconductor (NMOS) device, or some combination of PMOS and NMOS devices.

In certain embodiments, the number of LED devices 208A may each be coupled to a high voltage potential rail (e.g., "$V_{DD}$") and a low voltage potential rail or ground (e.g., "$V_{SS}$" or "GND"). For example, the high voltage potential rail (e.g., "$V_{DD}$") may be set to a voltage of 1.2V, 1.5V, 1.8V, 2.5V, 3.3V, 5V, or other similar voltage that may be used to supply power to the Subpixels 82 for operation. Similarly, the low voltage potential rail or ground (e.g., "$V_{SS}$" or "GND") 212A may be generally set to a ground voltage (e.g., 0 V or approximately 0 V).

Figure 8:
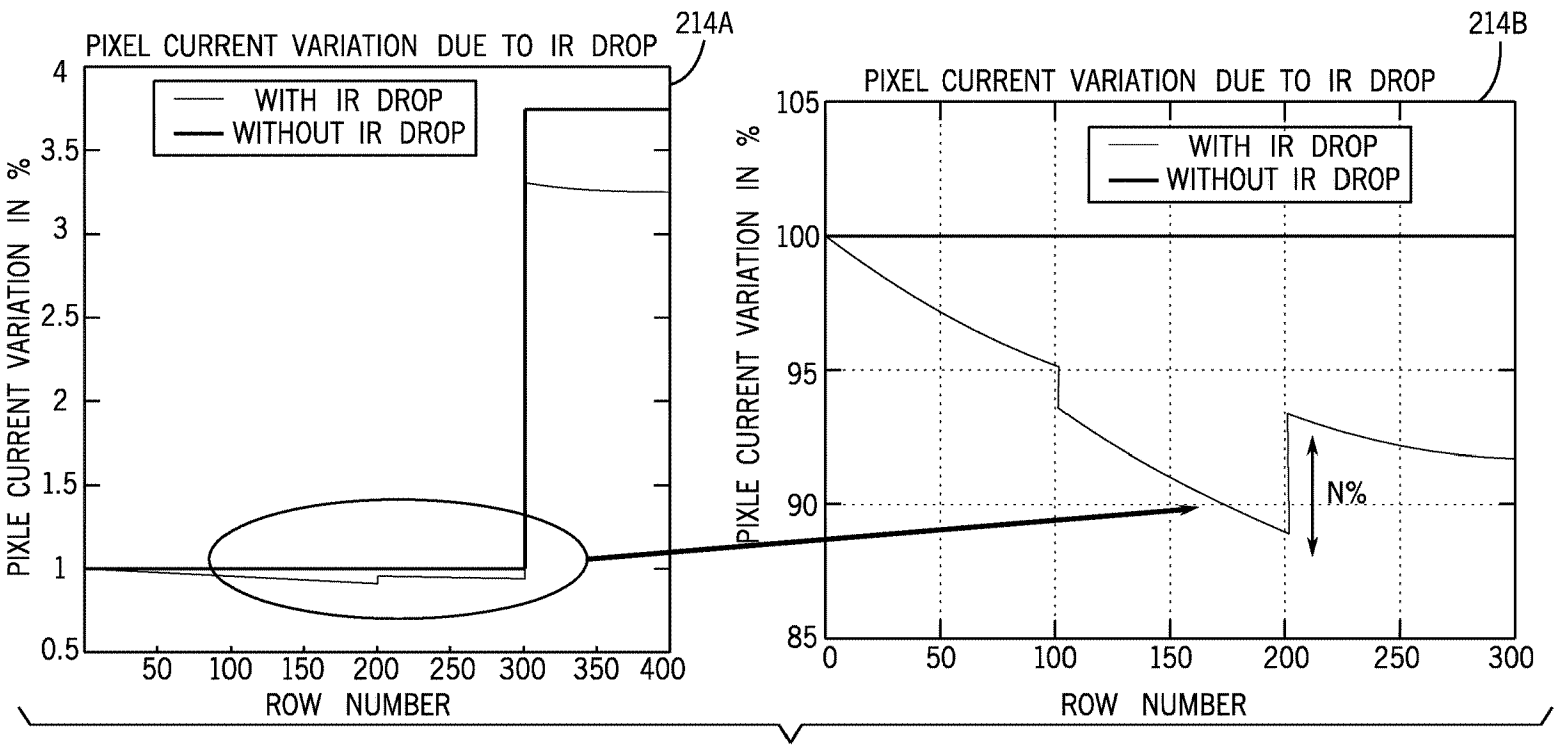
FIG. 8 illustrates plots and of the drive current variation due to IR drop supplied to the subpixels, in accordance with an embodiment.

In some embodiments, the uDs 78 may each include a PMOS driver used to drive the Subpixels 82. For example, PMOS drivers may be used as part of the uDs 78 in order to conserve physical area of the uLED display 18 by avoiding level shifters that may be otherwise involved. However, in some embodiments, utilizing PMOS drivers as part of the uDs 78 may lead to image artifacts (e.g., flicker) becoming present on the uLED display 18, as the PMOS drivers may be sensitive to variations of the high voltage potential rail (e.g., "$V_{DD}$") 210A. The variations of the high voltage potential rail (e.g., "$V_{DD}$") 210A may be caused by IR drop (e.g., voltage drops across the resistance R of the power supply 198A between supply pins and one or more components drawing a current I). For example, FIG. 8 illustrates plots 214A and 214B of the drive current (e.g., "$I_{LED}$") variation due to IR drop supplied to the subpixels 82. As illustrated, the IR drop may cause the drive current (e.g., "$I_{LED}$") of the subpixels 82 to vary by N % (e.g. 5-10% or otherwise significantly enough for the variation to appear as visible artifacts to a user of the uLED display 18).

Indeed, the $V_{DD}$ variations may vary depending on the incoming image data and the image pattern, as the luminance of the uLED display 18 and the characteristics of the subpixels 82 may also be variable. Furthermore, variations in the threshold voltage (e.g., "$V_{TH}$") of the subpixels 82 may also adversely impact the drive currents (e.g., "$I_{LED}$") of the subpixels 82. As may be further appreciated, the $V_{DD}$ and $V_{TH}$ variations may be exacerbated for larger area uLED displays 18. Thus, as will be further appreciated with respect to FIGS. 9-20, it may be useful to provide $V_{DD}$ and $V_{TH}$ compensation circuitry 205 as part of the uDs 78 to compensate for the aforementioned $V_{DD}$ and $V_{TH}$ adverse variations. In this way, any possible occurrence of image artifacts becoming apparent on the uLED display 18 may be reduced or substantially eliminated.

Figure 9:
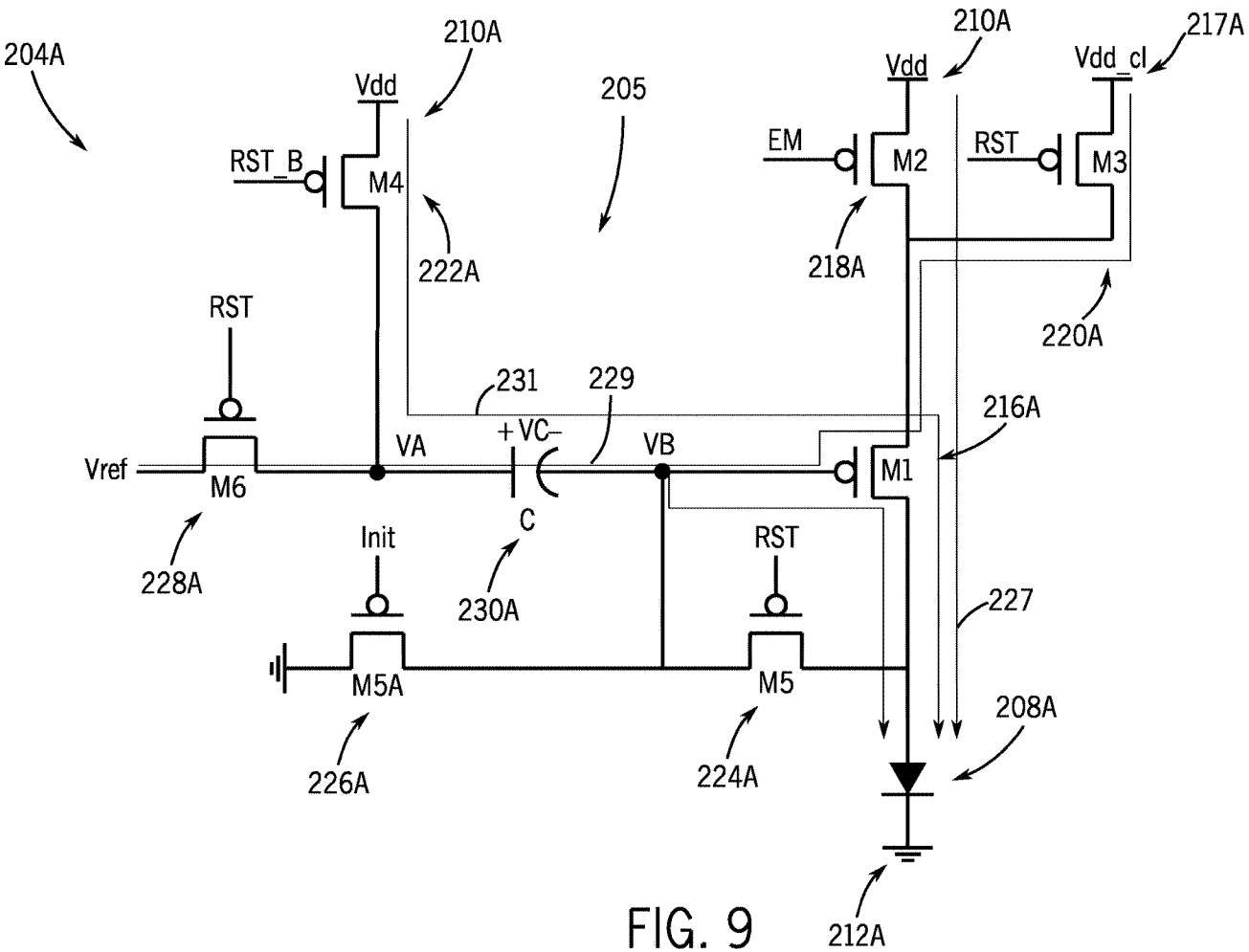
FIG. 9 is an embodiment of a circuit diagram (e.g., equivalent circuit) of the uDs including VDD and VTH compensation circuitry, in accordance with an embodiment.

Turning now to FIG. 9, which illustrates an embodiment of a circuit diagram (e.g., equivalent circuit) of the uDs 78 including $V_{DD}$ and $V_{TH}$ compensation circuitry 205 that may be used to compensate for the $V_{DD}$ and $V_{TH}$ variations that may be due to, for example, IR drop (e.g., voltage drops across the resistance R of the power supply 198A between supply pins and one or more components drawing a current I) associated the high voltage potential rail (e.g., "$V_{DD}$") 210A. In certain embodiments, the uDs 78 may be set to operate over one or more phases of the drive currents (e.g., "$I_{LED}$") of the subpixels 82.

For example, in an initial phase (e.g., "Phase 1"), the voltage VB may be low (e.g., approximately "GND" or 0 V). Thus, a PMOS transistor 224A (e.g., "M1") coupled (e.g., in series) between a PMOS transistor 226A (e.g., "M2") and the high voltage potential rail (e.g., "$V_{DD}$") 210A coupled directly to the high voltage potential rail (e.g., "$V_{DD}$") 210A may be "ON" (e.g., activated). The PMOS transistor 226A (e.g., "M2") may also be "ON," as the voltage EM may also be low (e.g., approximately "GND" or 0 V) in the initial phase (e.g., "Phase 1"). Accordingly, a drive current may be allowed to flow from the high voltage potential rail (e.g., "$V_{DD}$") 210A to the LED device 208A. In some embodiments, the PMOS transistor 224A (e.g., "M1") may be susceptible to $V_{DD}$ voltage variations, while the PMOS transistor 226A (e.g., "M2") may be susceptible to $V_{TH}$ voltage variations.

In certain embodiments, in a reset phase 229 (e.g., "Phase 2"), the voltage EM may be low (e.g., approximately "GND" or 0 V), while the voltages VA and VB may be expressed as:

$$VA = V_{Ref}. \quad \text{equation (1)}$$

$$VB = V_{DD_CL} - V_{TH}. \quad \text{equation (2)}$$

Specifically, in equation (1), $V_{Ref}$ may be the reference supply voltage for the LED device 208A that may be controlled by the PMOS 228A. In equation (2), $V_{DD_CL}$ may be an additional high voltage potential rail (e.g., "$V_{DD_CL}$") 217A (e.g., independent of the high voltage potential rail ("$V_{DD_CL}$") 210A). Thus, in the reset phase (e.g., "Phase 2"), when $V_A$=$V_{Ref}$ and $V_B$=$V_{DD_CL}$ $V_{TH}$, the following condition may exist:

$$VB=V_{DD_CL}-V_{TH}, \text{for } VB<V_{TH_LED} \quad \text{equation (3).}$$

In this case, the LED device 208A may not turn "ON." Furthermore, in the reset phase (e.g., "Phase 2"), the voltage VC (e.g., voltage across a compensation capacitance 230A) may be expressed as:

$$VC=V_{Ref}-V_{DD_CL}-V_{TH} \quad \text{equation (4).}$$

As may be appreciated from equation (4), the voltage VC may be a voltage across a compensation capacitance 230A that may, in some embodiments, be the difference between the reference voltage $V_{Ref}$ and the voltage VB.

In certain embodiments, in another reset phase 231 (e.g., "Phase 3"), the voltages VA and VB may be then expressed as:

$$VA = V_{DD}. \quad \text{equation (5)}$$

$$VB = VA - VC. \quad \text{equation (6)}$$

Expanding equations (5) and (6) based on equations (1), (2), and (4), the voltage VB may be then expressed as:

$$VB=V_{DD}-V_{Ref}+V_{DD_CL}-V_{TH} \quad \text{equation (7).}$$

Thus, when VB<$V_{DD}$−$V_{TH}$ and $V_{TH}$<$V_{DD_CL}$<$V_{Ref}$, the PMOS transistor 216A (e.g., "M1"), the PMOS transistor 224A (e.g., "M5"), and the PMOS transistor 228A (e.g., "M6") may each be "ON" (e.g., conductive or in the saturation mode). Indeed, further, when $V_{Ref}<V_{TH}<V_{TH\ Diode}$, the LED device 208A drive current $I_{LED}$ may be expressed as:

$$I_{LED}=K(V_{GS}-V_{TH})^2=K(V_{DD}-VB-V_{TH})^2 \quad \text{equation (8).}$$

Expanding equation (8) based on equation (7), the LED device 208A drive current $I_{LED}$ may be then expressed as:

$$I_{LED}=K(V_{DD}-(V_{DD}-V_{Ref}+V_{DD_CL}-V_{TH})-V_{TH})^2 \quad \text{equation (9).}$$

Lastly, simplifying equation (9), the LED device 208A drive current $I_{LED}$ may be expressed as:

$$I_{LED}=K(V_{Ref}+V_{DD_CL})^2 \quad \text{equation (10).}$$

Accordingly, equation (10) illustrates that LED device 208A drive current $I_{LED}$ may be independent of the high voltage potential rail (e.g., $V_{DD}$) and the threshold voltage (e.g., $V_{TH}$), and may thus compensate for $V_{DD}$ and $V_{TH}$ variations that may otherwise adversely affect drive current $I_{LED}$ (e.g., due to IR drop). Indeed, instead of being a function of $V_{DD}$ and $V_{TH}$ (e.g., as expressed by equation (8)) and, by extension, being susceptible to $V_{DD}$ and $V_{TH}$ variations (e.g., due to IR drop), the LED device 208A drive current $I_{LED}$ may be function of the uDs 78 reference voltage $V_{Ref}$ and the compensation voltage potential rail $V_{DD_CL}$. In this way, any possible occurrence of image artifacts becoming apparent on the uLED display 18 may be reduced or substantially eliminated.

Figure 10:
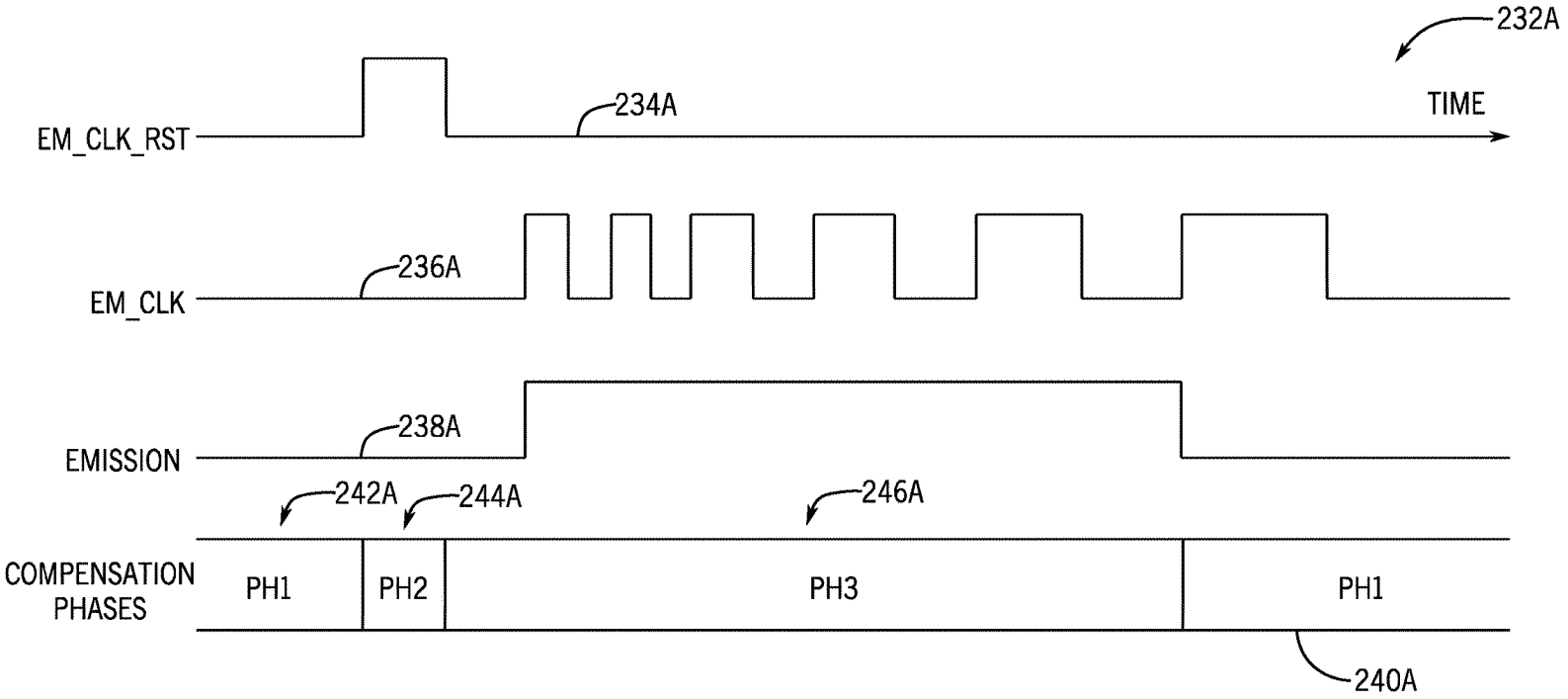
FIG. 10 is a timing diagram, which depicts VDD and VTH compensation phases (e.g., "PH1," "PH2," and "PH3"), in accordance with an embodiment.

As a further example of the presently disclosed embodiments, FIG. 10 illustrates a timing diagram 232A, which depicts each of the aforementioned $V_{DD}$ and $V_{TH}$ compensation phases (e.g., "PH1," "PH2," and "PH3"). Specifically, FIG. 10 illustrates an emission clock reset signal 232A (e.g., "EM_CLK_RST"), the LED device 208A drive current signal 236A (e.g., "EM_CLK"), LED device 208A emission signal 238A (e.g., "Emission"), and compensation phases timing signal 240A. As depicted in FIG. 10, during phase 1 (e.g., "PH1"), VB=0. During phase 2 (e.g., 229, "PH2"), corresponding to a period of time in which the uD 78 generates the emission clock reset signal 232A (e.g., "EM_CLK_RST"), $VA=V_{Ref}$ and $VB=V_{DD_CL}-V_{TH}$. In certain embodiments, during phase 3 (e.g., "PH3"), $VA=V_{DD}$ and $VB=V_{DD}-V_{Ref}+V_{DD_CL}-V_{TH}$. As illustrated, during phase 3 (e.g., "PH3"), the LED device 208A drive current signal 236A (e.g., "EM_CLK") may be activated, in which over the period of phase 3 (e.g., 231, "PH3") the duty cycle of the pulses of the of drive current signal 236A (e.g., "EM_CLK") may vary (e.g., corresponding to a period in which the LED device 208A is emitting as illustrated by the emission signal 238A) based on, for example, the incoming image data and the image pattern.

Figure 11:
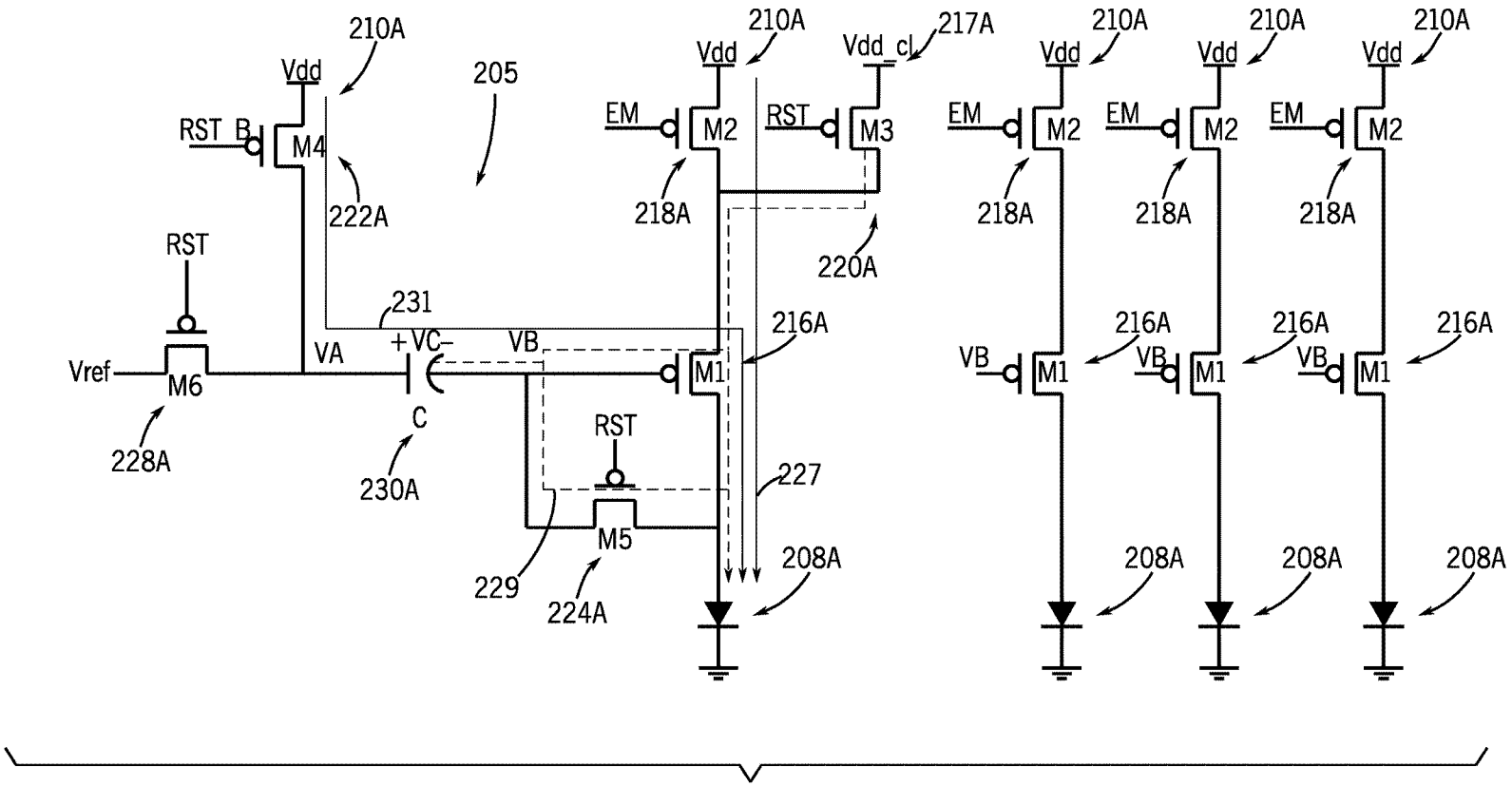
FIG. 11, is another embodiment of a circuit diagram (e.g., equivalent circuit) of the uDs including VDD and VTH compensation circuitry, in accordance with an embodiment.

Turning now to FIG. 11, which illustrates an embodiment of a circuit diagram (e.g., equivalent circuit) of the uDs 78 including $V_{DD}$ and $V_{TH}$ compensation circuitry 205 that may be used to compensate for the $V_{DD}$ and $V_{TH}$ variations that may be due to, for example, IR drop associated the high voltage potential rail (e.g., "$V_{DD}$") 210A. Specifically, FIG. 11 illustrates that the $V_{DD}$ and $V_{TH}$ compensation is shared between all LED device 208A with the same color (e.g., for each respective R, G, and B LED device 208A). For example, the uD 78 may provide $V_{DD}$ and $V_{TH}$ compensation for each color red LED device 208A of the uLED display 18, green LED device 208A of the uLED display 18, and blue LED device 208A of the uLED display 18.

Figure 12:
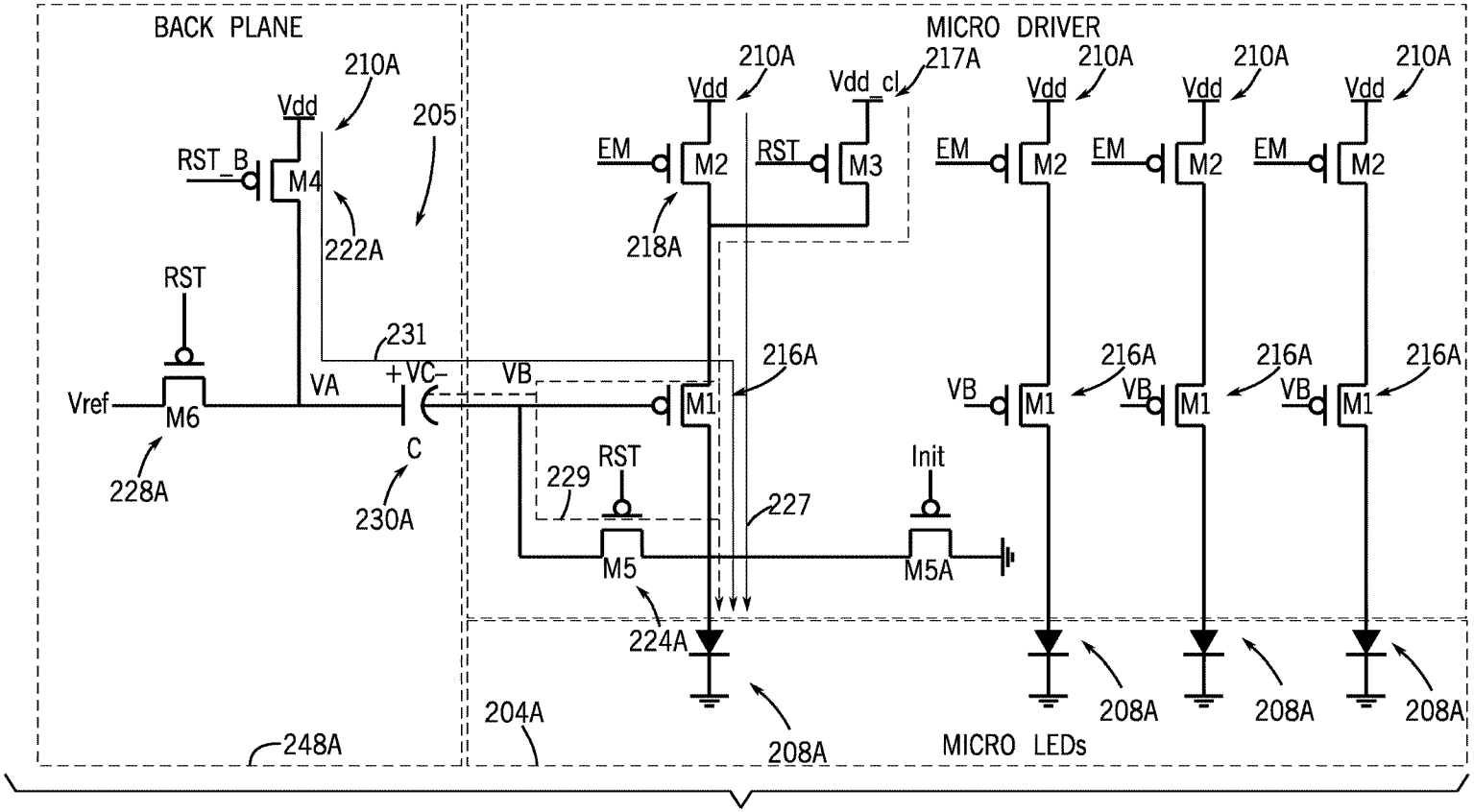
FIG. 12 illustrates an embodiment of a circuit diagram (e.g., equivalent circuit) of the uDs including $V_{DD}$ and $V_{TH}$ compensation circuitry included as part of the backplane of the display, in accordance with an embodiment.

FIG. 12 illustrates an embodiment of a circuit diagram (e.g., equivalent circuit) of the uDs 78 including $V_{DD}$ and $V_{TH}$ compensation circuitry 205 included as part of the backplane 248A (e.g., as opposed to being included as part of the uDs 78). Similarly, as discussed in FIG. 11, the uD 78 may provide $V_{DD}$ and $V_{TH}$ compensation for each color red LED device 208A of the uLED display 18, green LED device 208A of the uLED display 18, and blue LED device 208A of the uLED display 18.

Figure 13:
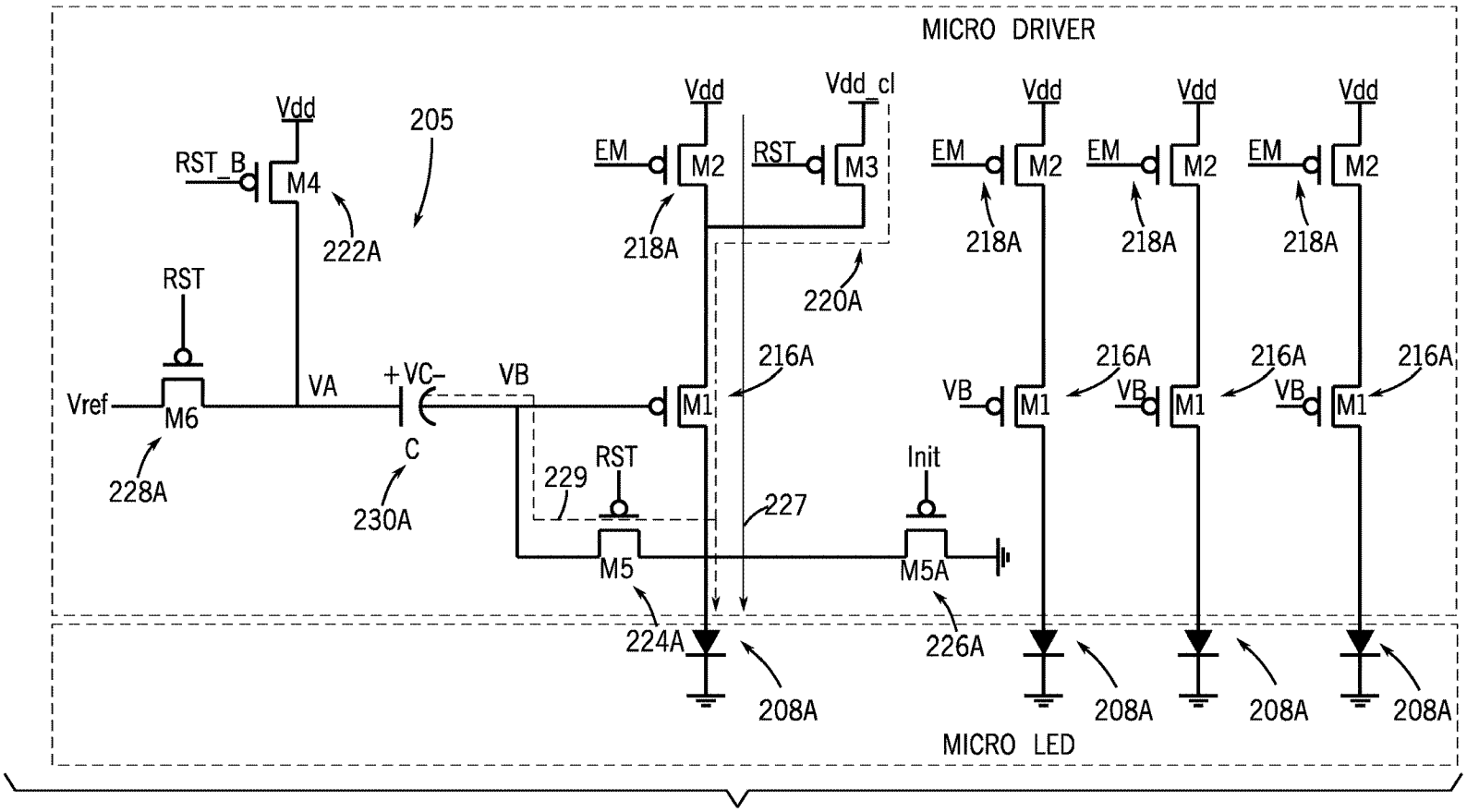
FIG. 13 illustrates an embodiment of a circuit diagram (e.g., equivalent circuit) of the uDs including $V_{DD}$ and $V_{TH}$ compensation circuitry included as part of the micro drivers, in accordance with an embodiment.

FIG. 13 illustrates an embodiment of a circuit diagram (e.g., equivalent circuit) of the uDs 78 including $V_{DD}$ and $V_{TH}$ compensation circuitry 205 included as part of the uDs 78. Specifically, FIG. 13 illustrates that the $V_{DD}$ and $V_{TH}$ compensation circuitry 205 may be used to generate a shared current source (e.g., allowing the same reference current to be shared across multiple color subpixels 82 by scaling the singular reference current source) locally at the uD 78. For example, the uD 78 may provide $V_{DD}$ and $V_{TH}$ compensation for each of the red LED device 208A, green LED device 208A, and blue LED device 208A. Such a configuration may allow the each uD 78 to include respective $V_{DD}$ and $V_{TH}$ compensation circuitry 205.

Figure 14:
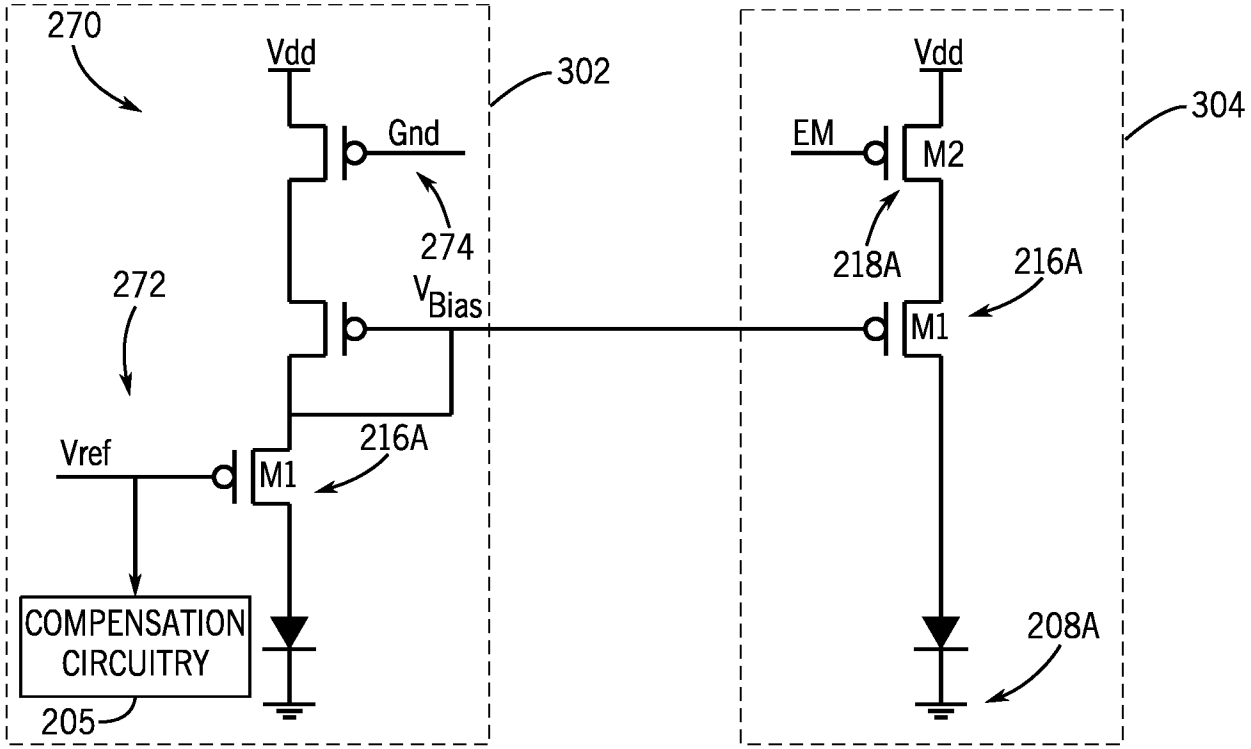
FIG. 14 illustrates an embodiment of a circuit diagram (e.g., equivalent circuit) of the uDs including noise reduction circuitry, in accordance with an embodiment.

FIG. 14 illustrates an embodiment of a circuit diagram (e.g., equivalent circuit) of the uDs 78 including noise reduction circuitry 270. Indeed, in some embodiments, $V_{DD}$ noise could be generated by sparks emanating from on/off of each subpixel 82. FIG. 14 illustrates that a voltage reference 272 (e.g., "$V_{Ref}$") and a clean ground voltage (e.g., "GND") 274 that may be included as part of each uD 78. Furthermore, FIG. 14 illustrates the current may be generated locally by the uD 78 and used as a reference for each subpixel 82.

Figure 15:
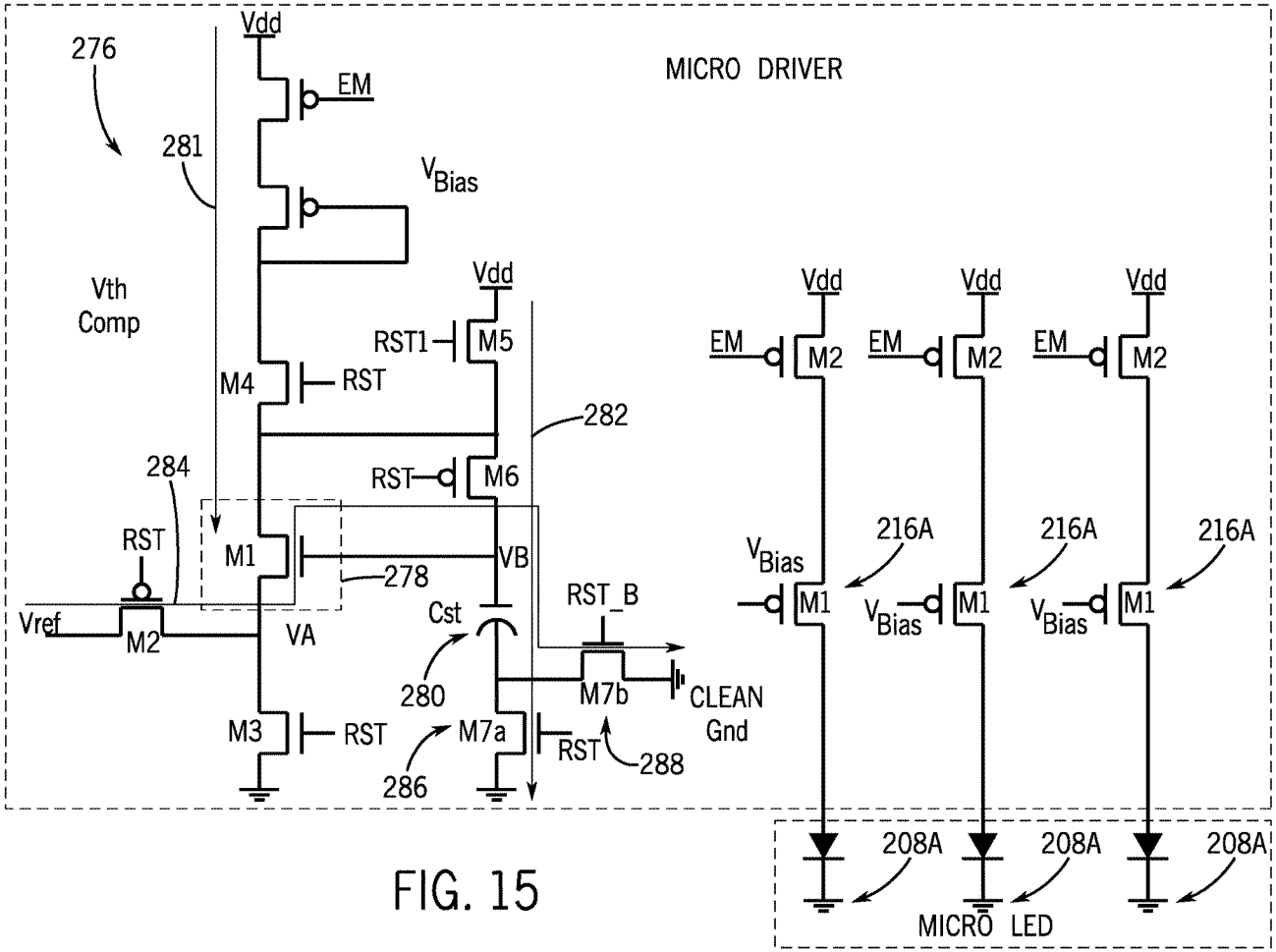
FIG. 15, is another embodiment of a circuit diagram (e.g., equivalent circuit) of the uDs including $V_{DD}$ and $V_{TH}$ compensation circuitry, in accordance with an embodiment.
Figure 16:
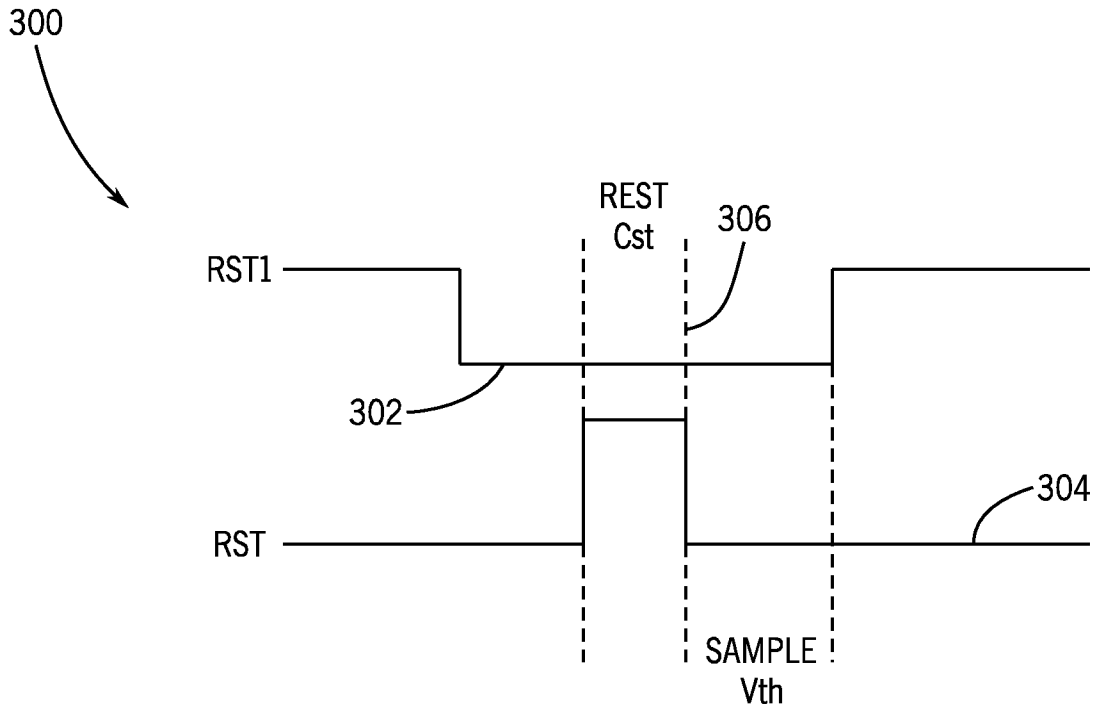
FIG. 16 illustrates a plot diagram for a compensation capacitor illustrating the reset phases, in accordance with an embodiment.

Turning now to FIG. 15, which illustrates an embodiment of a circuit diagram (e.g., equivalent circuit) of the uDs 78 including $V_{SS}$ and $V_{TH}$ compensation circuitry 205 that may be used to compensate for $V_{SS}$ and $V_{TH}$ variations including NMOS devices. In certain embodiments, the uDs 78 may be set to operate over one or more phases of the drive currents (e.g., "$I_{LED}$") of the subpixels 82. For example, in an initial phase (e.g., "PH1"), the voltage $VA=V_{Ref}$ and $=V_{DD}$. In the sampling phase (e.g., "PH2"), $VB=V_{Ref}+V_{TH}$, and the drive current may flow as depicted by the phase 1 path 281. Lastly, in the operation phase (e.g., "PH3"), the drive current $I_{M1}=I_0$. The phase 2 path 282 and phase 3 path 284 are depicted passing through the NMOS transistors 278 (e.g., "M1"), compensation capacitor 280, and NMOS transistors 286 (e.g., "M7*a*") and 288 (e.g., "M7*b*"), which includes a clean ground voltage for phase 2 (e.g., "PH2"). Thus, $I_{M1}$ (e.g., the drive current across the NMOS transistor 278) may not be dependent upon $V_{SS}$ and $V_{TH}$, and instead dependent upon only the reference current $I_0$. FIG. 16 illustrates the corresponding plot diagram 300 for the compensation capacitor 280 illustrating the reset phases 302 and 304, and compensation capacitor period 306.

Figure 17:
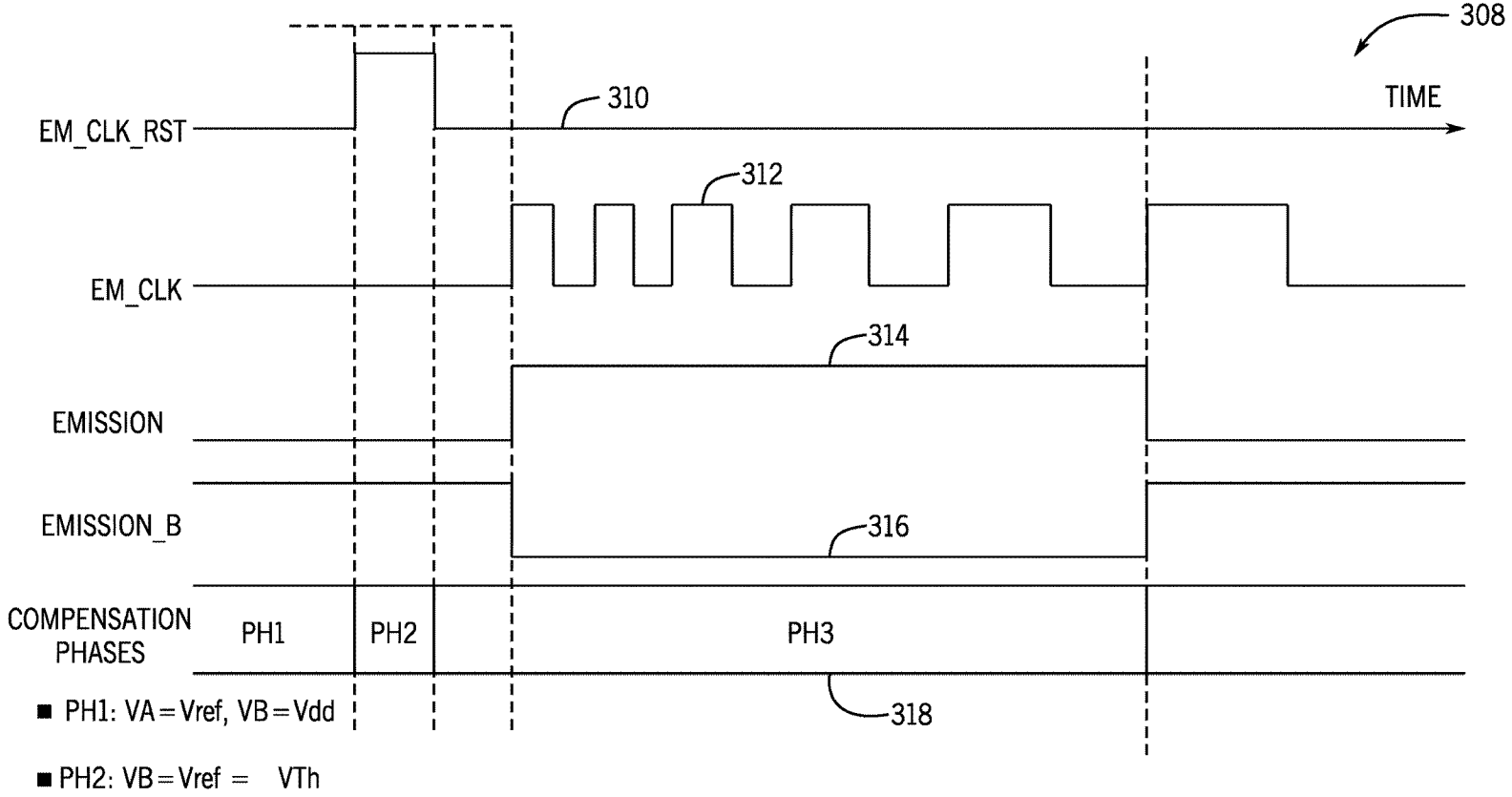
FIG. 17 is a timing diagram, which depicts $V_{DD}$ and $V_{TH}$ compensation phases (e.g., "PH1," "PH2," and "PH3"), in accordance with an embodiment.

As a further example, FIG. 17 illustrates a timing diagram 308, which depicts each of the aforementioned $V_{SS}$ and $V_{TH}$ compensation phases (e.g., "PH1," "PH2," and "PH3"). Specifically, FIG. 17 illustrates an emission clock reset signal 310 (e.g., "EM_CLK_RST"), the LED device 208A drive current signal 312 (e.g., "EM_CLK"), LED device 208A emission signal 314 (e.g., "Emission"), LED device 208A emission signal 316 (e.g., "Emission_B"), and compensation phases timing signal 318. As depicted in FIG. 17, during phase 1 (e.g., "PH1"), $VA=V_{Ref}$ and $VB=V_{DD}$. During phase 2 (e.g., "PH2"), corresponding to a period of time in which the uD 78 generates the emission clock reset signal 310 (e.g., "EM_CLK_RST"), $VB=V_{Ref}+V_{Ref}$. In certain embodiments, during phase 3 (e.g., "PH3"), $I_{M1}=I_0$. Thus, $I_{M1}$ may not be dependent upon $V_{SS}$ and $V_{TH}$.

Figure 18:
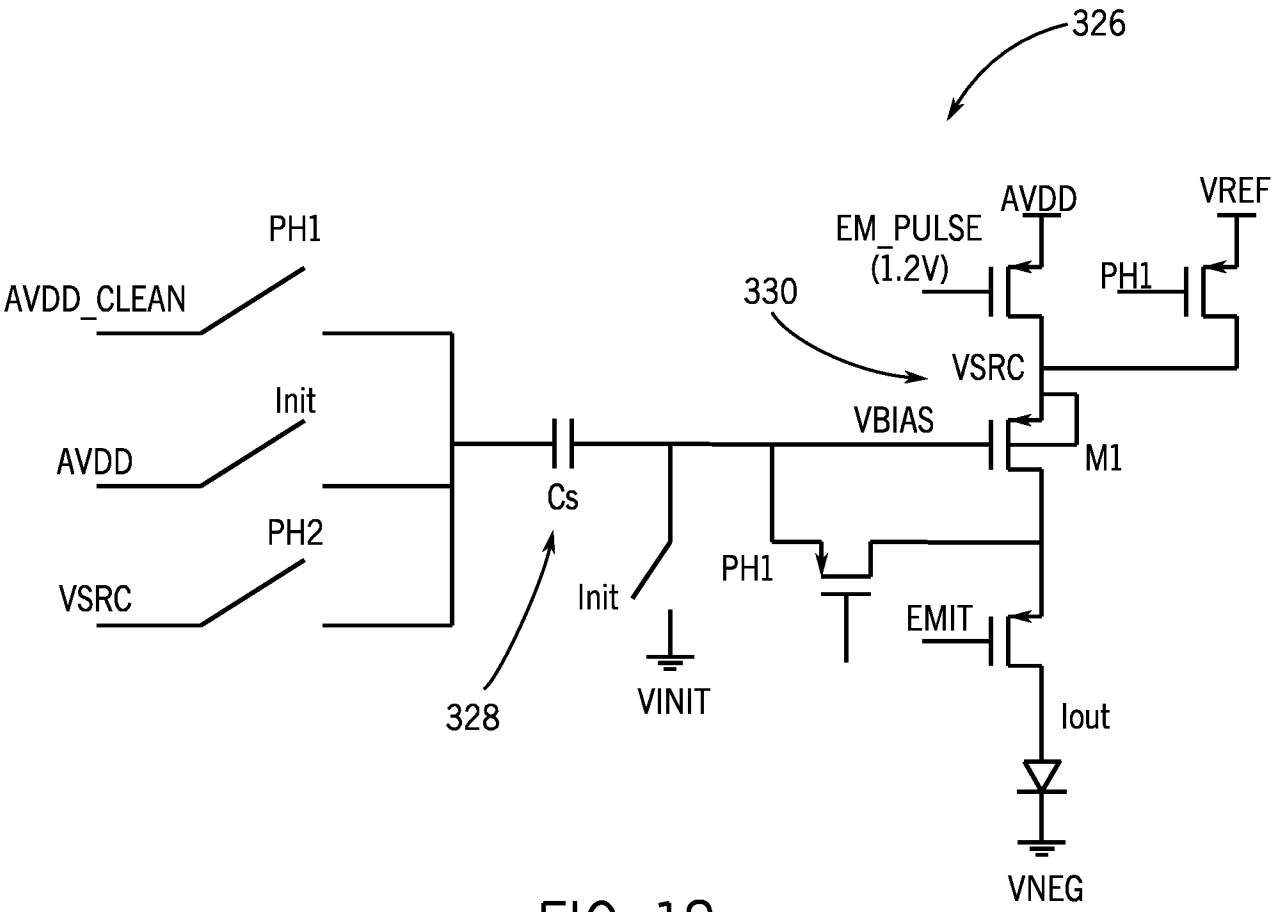
FIG. 18 illustrates an embodiment of a circuit diagram (e.g., equivalent circuit) including dedicated compensation circuitry for each subpixel.
Figure 19:
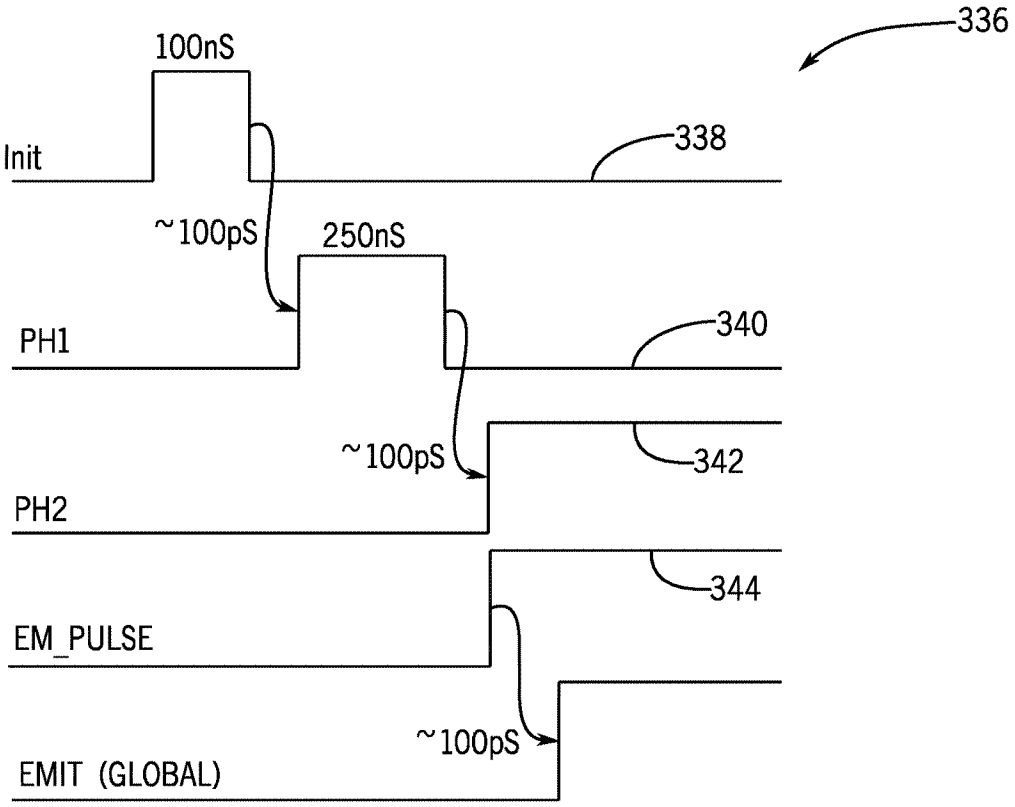
FIG. 19 is a timing diagram, which depicts $V_{SS}$ and $V_{TH}$ compensation phases, in accordance with an embodiment.

FIG. 18 illustrates an embodiment of a circuit diagram (e.g., equivalent circuit) including dedicated compensation circuitry 205 for each subpixel 82. In this embodiment, $V_{Ref}$ and $V_{DD}$ may include one or more clean pin swaps. Specifically, in phase 2 (e.g., "PH2"), the left plate of the sampling capacitor 328 (e.g., "$C_s$") may be connected to the source terminal of the EM switch 326 (e.g., node VSRC). In this way, any $AV_{DD}$ IR variation due to the finite resistance of the EM switch 330 may be eliminated and/or substantially reduced. In some embodiments, the voltage "VINIT" may be a ground voltage (e.g., GND) or a negative polarity voltage. FIG. 19 illustrates the corresponding timing diagram for the initiation phase 338 (e.g., "Init"), phase 1 340 (e.g., "PH1"), and phase 2 342 (e.g., "PH2), and the emission pulse 344 (e.g., EM_Pulse).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A micro light-emitting diode (micro-LED) display panel, comprising:

an LED driver configured to supply and regulate power to an LED, comprising:

a first transistor having a first source coupled to an upper voltage rail, a first gate, and a first drain, wherein the first transistor is configured to pass a drive current signal from the upper voltage rail;

a second transistor having a second source coupled to the first drain of the first transistor, a second gate, and a second drain coupled to the LED, wherein the second transistor is configured to receive the drive current signal from the first transistor and supply the drive current signal to the LED; and compensation circuitry configured to adjust the drive current signal such that the drive current signal is independent of the upper voltage rail and a threshold voltage of the first transistor or the second transistor, wherein the compensation circuitry comprises a third transistor coupled between the first drain of the first transistor and an additional upper voltage rail that is independent of the upper voltage rail.

2. The micro-LED display panel of claim 1, wherein the first transistor comprises a p-type metal-oxide-semiconductor.

3. The micro-LED display panel of claim 1, wherein the second transistor comprises a p-type metal-oxide-semiconductor.

4. The micro-LED display panel of claim 1, wherein the compensation circuitry comprises a capacitance configure to store a compensation voltage based on a second upper voltage rail and a sampling of the threshold voltage.

5. The micro-LED display panel of claim 1, wherein the compensation circuitry is configured to adjust the drive current signal over a plurality of phase periods.

6. The micro-LED display panel of claim 1, wherein the compensation circuitry is configured to adjust the drive current signal for each LED of a same color of a plurality of LEDs of the micro-LED display panel.

7. The micro-LED display panel of claim 1, wherein the compensation circuitry is configured to provide the adjusted drive current signal for each of various color LEDs of the micro-LED display panel.

8. The micro-LED display panel of claim 1, wherein the compensation circuitry is configured to adjust the drive current signal to render the drive current signal immune to variations in the upper voltage rail and the threshold voltage based on current-resistance drop.

9. The micro-LED display panel of claim 1, comprising a plurality of LED drivers each configured to supply and regulate power to one or more respective LEDs.

10. An electronic device, comprising:

a device driver configured to:

generate a drive current to supply to light-emitting diode (LED) pixels of a micro light-emitting diode (micro-LED) display, wherein the device driver comprises a plurality of p-type metal-oxide-semiconductor (PMOS) transistors; and adjust the drive current such that the drive current is independent of an upper voltage rail voltage and a threshold voltage of the plurality of PMOS transistors; and a compensation transistor configured to receive a compensation voltage from a compensation upper voltage rail and to inject the compensation voltage between two PMOS transistors of the plurality of PMOS transistors, wherein the compensation upper voltage rail is independent of the upper voltage rail.

11. The electronic device of claim 10, wherein the device driver is configured to adjust the drive current to render the drive current immune to signal variations of the upper voltage rail.

12. The electronic device of claim 10, wherein the device driver is configured to adjust the drive current to render the drive current immune to signal variations of the threshold voltage.

13. The electronic device of claim 10, wherein the device driver is configured to adjust the drive current to eliminate a possible occurrence of image artifacts becoming apparent on the micro-LED display.

14. A method, comprising:

generating, using driving circuitry, a drive current to supply to a light-emitting diode (LED) of a micro light-emitting diode (micro-LED) display, wherein the drive current is expressed by:

$$I_{LED}=K(V_{Ref}+V_{DD\text{-}CL})^2,$$

wherein $I_{LED}$ is the drive current, K is a function coefficient, $V_{Ref}$ is a reference current voltage of micro-drivers of the micro-LED display, and $V_{DD_CL}$ is a voltage of a compensation voltage potential rail that is independent of a voltage potential rail of the micro-LED display; and driving a micro-LED of the micro-LED display using the drive current.

15. The method of claim 14, wherein generating the drive current comprises generating the drive current over at least three phase periods.

16. The method of claim 15, wherein generating the drive current comprises generating the drive current based on a voltage at a gate of a transistor coupled to the LED during a second phase period of the at least three phase periods, wherein the voltage is expressed as:

$$VB=V_{DD}-V_{Ref}+V_{DD_{CL}}-V_{TH},$$

wherein VB is the voltage at the gate, $V_{DD}$ is the voltage potential rail of the micro-LED display, and $V_{TH}$ is a threshold voltage of the transistor or another transistor in the micro-LED display.

17. The method of claim 14, wherein generating the drive current comprises generating a second drive current prior to generating the drive current is expressed as:

$$I_{LED}=K(V_{DD}-(V_{DD}-V_{Ref}+V_{DD_CL}-V_{TH})-V_{TH})^2,$$

wherein $V_{DD}$ is the voltage potential rail of the micro-LED display, and $V_{TH}$ is a threshold voltage of the transistor, and wherein generating the drive current comprises eliminating a dependence of the drive current on an upper voltage rail and the threshold voltage.

18. The method of claim 14, wherein generating the drive current comprises generating a second drive current expressed as: $I_{M1}=I_0$, wherein the $I_{M1}$ comprises a current across an n-type metal-oxide-semiconductor transistor of the micro-LED display and $I_0$ comprises a reference current, and wherein generating the second drive current comprises eliminating a dependence of the second drive current on a lower voltage rail and a threshold voltage.

* * * * *